US010889939B2

(12) United States Patent
Chen et al.

(10) Patent No.: US 10,889,939 B2
(45) Date of Patent: Jan. 12, 2021

(54) SIZING METHOD FOR MAKING PAPER AND PAPER PREPARED THEREOF

(71) Applicant: Ecolab USA Inc., St. Paul, MN (US)

(72) Inventors: Zhi Chen, Shanghai (CN); Jinhai Xiao, Hubei (CN); Xiaofeng Zhang, Jiangsu (CN); Kun Hou, Shanghai (CN); James L. Thomas, Naperville, IL (US); Kaihong Huang, Fujian (CN)

(73) Assignee: ECOLAB USA INC., St. Paul, MN (US)

( * ) Notice: Subject to any disclaimer, the term of this patent is extended or adjusted under 35 U.S.C. 154(b) by 93 days.

(21) Appl. No.: 16/064,262

(22) PCT Filed: Dec. 26, 2016

(86) PCT No.: PCT/CN2016/112055
§ 371 (c)(1),
(2) Date: Jun. 20, 2018

(87) PCT Pub. No.: WO2017/108005
PCT Pub. Date: Jun. 29, 2017

(65) Prior Publication Data

US 2019/0003125 A1 Jan. 3, 2019

(30) Foreign Application Priority Data

Dec. 25, 2015 (CN) ..... 2015 1 0994194

(51) Int. Cl.
*D21H 21/16* (2006.01)
*D21H 17/15* (2006.01)
(Continued)

(52) U.S. Cl.
CPC ..... *D21H 21/16* (2013.01); *D21H 17/14* (2013.01); *D21H 17/15* (2013.01); *D21H 17/17* (2013.01);
(Continued)

(58) Field of Classification Search
None
See application file for complete search history.

(56) References Cited

U.S. PATENT DOCUMENTS 3,102,064 A 8/1963 Wurzburg
3,234,076 A 2/1966 Goldsmith
(Continued)

FOREIGN PATENT DOCUMENTS

CN 1432088 A 7/2003
CN 1449464 A 10/2003
(Continued)

OTHER PUBLICATIONS

Farley et al., "Sizing with Alkenyl Succinic Anhydride," *The Sizing of Paper,* 2nd. ed., Tappi Press, pp. 51-62, 1989.
(Continued)

*Primary Examiner* — Dennis R Cordray
(74) *Attorney, Agent, or Firm* — Eric D. Babych; Barnes & Thornburg LLP

(57) ABSTRACT

The present application discloses a sizing method for making paper. An alkenyl succinic anhydride (ASA) is added to a papermaking process. An aluminum salt is added in one or more process steps during the papermaking process. Preferably, the aluminum salt is an aluminum salt which can generate free aluminum ion in aqueous solution. The sizing method of the present application enhances the usage efficiency of a sizing agent and the aluminum salt, as well as provides paper having a high moisture content.

13 Claims, 4 Drawing Sheets

(51) Int. Cl.

| | |
|---|---|
| ***D21H 17/66*** | (2006.01) |
| ***D21H 17/62*** | (2006.01) |
| ***D21H 17/17*** | (2006.01) |
| ***D21H 17/28*** | (2006.01) |
| ***D21H 17/00*** | (2006.01) |
| ***D21H 23/24*** | (2006.01) |
| ***D21H 23/26*** | (2006.01) |
| ***D21H 23/28*** | (2006.01) |
| ***D21H 17/14*** | (2006.01) |
| ***D21H 17/70*** | (2006.01) |

(52) U.S. Cl.

CPC ..... *D21H 17/28* (2013.01); *D21H 17/62* (2013.01); *D21H 17/66* (2013.01); *D21H 17/70* (2013.01); *D21H 17/74* (2013.01); *D21H 23/24* (2013.01); *D21H 23/26* (2013.01); *D21H 23/28* (2013.01)

(56) References Cited

U.S. PATENT DOCUMENTS

| | | | | |
|---|---|---|---|---|
| 3,821,069 | A * | 6/1974 | Wurzburg | D21H 17/16 162/158 |
| RE28,474 | E | 7/1975 | Anderson et al. | |
| RE28,576 | E | 10/1975 | Anderson et al. | |
| 3,968,005 | A | 7/1976 | Wurzburg | |
| 4,040,900 | A | 8/1977 | Mazzarella et al. | |
| 4,533,434 | A | 8/1985 | Yoshioka et al. | |
| 4,657,946 | A | 4/1987 | Rende et al. | |
| 4,915,786 | A | 4/1990 | Sweeney | |
| 4,956,399 | A | 9/1990 | Kozakiewicz et al. | |
| 5,324,792 | A | 6/1994 | Ford | |
| 5,438,087 | A | 8/1995 | Ikeda et al. | |
| 5,865,951 | A | 2/1999 | Kawakami et al. | |
| 6,348,132 | B1 | 2/2002 | Zhang et al. | |
| 6,787,574 | B1 | 9/2004 | Farley et al. | |
| 7,455,751 | B2 | 11/2008 | Ward et al. | |
| 7,550,060 | B2 | 6/2009 | Jacobson et al. | |
| 7,758,934 | B2 * | 7/2010 | Bays | B41M 5/52 162/134 |
| 7,914,646 | B2 | 3/2011 | Duggirala et al. | |
| 8,709,555 | B2 * | 4/2014 | Pal | B41M 5/508 162/135 |
| 8,852,400 | B2 | 10/2014 | St. John et al. | |
| 2003/0224945 | A1 | 12/2003 | Twu et al. | |
| 2004/0256065 | A1 * | 12/2004 | Ahmed | D21B 1/00 162/26 |
| 2006/0201645 | A1 | 9/2006 | Ito | |
| 2008/0277084 | A1 | 11/2008 | Denowski et al. | |
| 2009/0281212 | A1 | 11/2009 | Pawlowska et al. | |
| 2011/0017417 | A1 | 1/2011 | Ehrhardt | |
| 2012/0103546 | A1 | 5/2012 | Maniere | |
| 2012/0103547 | A1 | 5/2012 | Grimm et al. | |
| 2014/0069600 | A1 * | 3/2014 | Furman, Jr. | C08G 73/028 162/164.6 |
| 2017/0218571 | A1 | 8/2017 | St. John et al. | |

FOREIGN PATENT DOCUMENTS

| | | | |
|---|---|---|---|
| CN | 1659338 | A | 8/2005 |
| CN | 101466896 | A | 6/2009 |
| CN | 101495687 | A | 7/2009 |
| CN | 101495698 | A | 7/2009 |
| CN | 101547789 | A | 9/2009 |
| CN | 101787664 | A | 7/2010 |
| CN | 102011341 | A | 4/2011 |
| CN | 102261015 | A | 11/2011 |
| CN | 102388181 | A | 3/2012 |
| CN | 102472018 | A | 5/2012 |
| CN | 103628352 | A | 3/2014 |
| CN | 104781471 | A | 7/2015 |
| CN | 106917324 | A | 7/2017 |
| EP | 0151994 | A2 | 8/1985 |
| JP | 6-299494 | A | 10/1994 |
| JP | 2006-152510 | A | 6/2006 |
| JP | 2012-007283 | A | 1/2012 |
| JP | 2012-107356 | A | 6/2012 |
| WO | WO 97/05330 | A1 | 2/1997 |
| WO | WO 97/10387 | A1 | 3/1997 |
| WO | WO 2006/113519 | A2 | 10/2006 |

OTHER PUBLICATIONS

Friberg et al., "Emulsions," *Encyclopedia of Chemical Technology,* 4th ed., vol. 9, Dec. 4, 2000.

Smook, *Handbook for Pulp and Paper Technologists, 2nd ed.,* Angus Wilde Publications, 1992, pp. 220-227.

European Patent Office, Extended European Search Report in European Patent Application No. 13855150.2, dated Jun. 15, 2016, 12 pp.

State Intellectual Property Office of the People'S Republic of China, First Office Action in Chinese Patent Application No. 201510994194.6, 10 pp. (dated Jan. 19, 2018).

State Intellectual Property Office of the People'S Republic of China, International Search Report in International Patent Application No. PCT/CN2016/112055, 7 pp. (dated Mar. 31, 2017).

State Intellectual Property Office of the People'S Republic of China, Written Opinion in International Patent Application No. PCT/CN2016/112055, 4 pp. (dated Mar. 31, 2017).

* cited by examiner

SIZING METHOD FOR MAKING PAPER AND PAPER PREPARED THEREOF

CROSS-REFERENCE TO RELATED APPLICATION

This patent application is a national phase application of International Patent Application No. PCT/CN2016/112055, filed Dec. 26, 2016, which claims priority to Chinese Patent Application No. 201510994194.6, filed Dec. 25, 2015, each of which is incorporated by reference herein in its entirety.

TECHNICAL FIELD

The present application relates to a sizing method for making paper and a paper prepared by a method thereof.

BACKGROUND OF THE INVENTION

In the papermaking industry, sizing technology is commonly utilized to make paper having water resistance and hot water penetration resistance by manipulating the internal sizing and paper surface sizing of the paper. Internal sizing methods commonly involve adding a sizing agent such as alkyl ketene dimer (AKD), alkenyl succinic anhydride (ASA), or rosin size directly to a paper furnish. In general, particles of the sizing agent are capable of forming larger agglomerates which are adsorbed onto the surfaces of the fibers and fillers of the paper furnish. These particles are generally retained in the wet paper sheet, and in the drying section. Influenced by drying temperature, the particles of the sizing agent generally melt and spread onto the fiber surface. Reactive functional groups of the sizing agent direct inward toward the fibers and hydrophobic groups of the sizing agent direct outward away from the fibers. The reactive functional groups react with a hydroxyl group of the cellulose of the fiber, forming a covalent bond and resulting in sizing of the paper.

ASA has a number of advantages for paper sizing when compared to AKD. ASA provides rapid sizing over a wide pH range, is easily emulsified, and is compatible with aluminum sulfate. ASA is also more easily synthesized, inexpensive, and is less of an environmental pollutant. ASA has been utilized in high-grade paper production worldwide, and is suitable for producing high-grade cultural paper, coating paper, paperboard, and the like. However, ASA hydrolyzes easily due to high reactivity. Furthermore, sizing masking and sizing reversion is known to occur when using ASA, resulting in problems such as knobbling roll adherence and scaling. In particular, the hydrolysis of ASA is often severe when ASA is used in processes for preparing paper with high moisture content.

Japanese Patent Application JP 2006152510 discloses adding a metal salt and ASA to a surface sizing agent. However, the internal sizing agent is severely hydrolyzed due to high temperatures, thereby resulting in a loss of sizability. Furthermore, the hydrolysate of ASA was observed to adhere to equipment as an adhesive, resulting in the need for a high dosage of ASA. In this case, the sizing effect is merely generated on the surface of the paper and the internal sizing of the paper cannot be effectively controlled.

Chinese Patent Application CN 102472018 A discloses a method for increasing the resistance of paperboard to hot penetrant permeation. During the preparation and the approaching processes of paper furnish, an insoluble agent such as an aluminum sulfate and the like is added separately or in blended form into water-containing paper furnish to increase the resistance of paperboard to hot penetrant permeation to achieve a stable sizing effect of the paper. The disadvantage of this method is that a large amount of aluminum salt in the furnish causes a change in pH and conductivity in the wet part of the papermaking machine, resulting in foaming and disposition and a decrease in paper quality and production efficiency. Therefore, the problems of sizing masking and sizing reversion of the final paper cannot be effectively solved by this method.

BRIEF SUMMARY OF THE INVENTION

Below is a summarization of the detailed subject matters of the present application. And such summarization is not intended to limit the scope of claims.

In an embodiment, the present application provides a sizing method for making paper. The method comprises adding alkenyl succinic anhydride to a papermaking furnish in a papermaking process, and adding an aluminum salt to one or more process steps during the papermaking process.

In another embodiment, the present application provides a paper prepared by adding alkenyl succinic anhydride to a papermaking furnish in a papermaking process, and adding an aluminum salt to one or more process steps during the papermaking process.

DETAILED DESCRIPTION OF THE INVENTION

Figure 1:
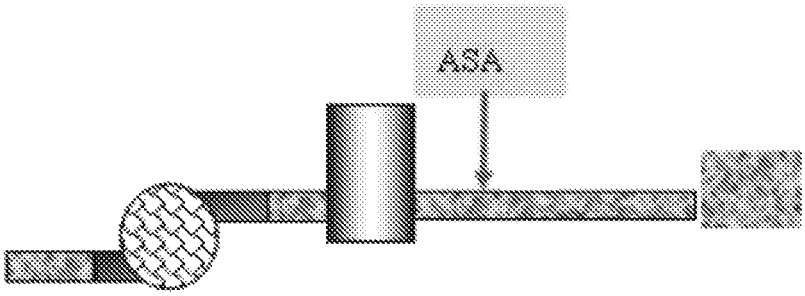
FIG. 1 is an operational flowchart of addition of ASA in Comparative Example 1 and Example 2.

The embodiments of the present application are expounded as follows. It should be understood that, the embodiments described herein are merely for illustrating and explaining the present application, rather than to limit the present application.

"Papermaking process" refers to a whole process which starts from the paper furnish flowing to a headbox until the forming of the final paper. Moreover, it should also be understood by those skilled in the art that technical effects similar to those of the present application also can be achieved by adding the aluminum salt in the subsequent processing procedure of the paper such as in a dyeing process of the paper, or in the subsequent processing procedure of the paper.

The present application provides a sizing method for making paper. The method comprises adding alkenyl succinic anhydride (ASA) to a papermaking furnish during a papermaking process, and adding an aluminum salt in one or more process steps during a papermaking process. In certain embodiments, the aluminum salt is an aluminum salt which can generate a free aluminum ion in aqueous solution.

In certain embodiments, the one or more process steps during the papermaking process are selected from a group consisting of: a process step at a forming section of the paper machine, a process step at a multilayer paperboard combining section, a process step at a press section, a process step at drying section, and a process step at a surface sizing section. In certain embodiments, the one or more process steps during the papermaking process comprise the process step at the surface sizing section.

In certain embodiments, the ASA has the following structural formula:

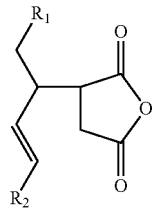

wherein $R_1$ and $R_2$ are alkyl. In certain embodiments, $R_1$ and $R_2$ have 12 to 22 total number of carbon atoms.

In certain embodiments, the ASA is commercially available. In certain embodiments, the ASA is prepared as is known in the art. In certain embodiments, the ASA is prepared by the following reaction:

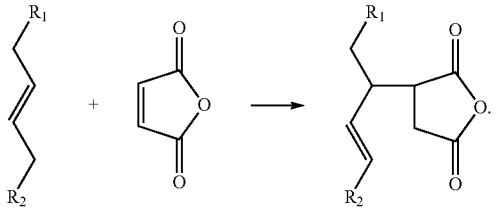

In certain embodiments, ASA can be prepared according to the method disclosed in the reference: *Chemical Principle of the Wet Part for Making Paper and Application Thereof,* 1st edition, September, 1998, pp. 127-128, edited and translated by Guanghua Zhang, reviewed by Jiabao Lao, *Papermaking Chemical,* 1st edition, January, 2002, page 211, written and edited by Huiren Hu, Lixin, Xu, and Rongye Dong.

In certain embodiments, the ASA is added to the wet end of the papermaking process. In certain embodiments, the ASA is added prior to the addition of the aluminum salt. In certain embodiments, the ASA is added to the paper pulp and the paper sheet is coated with an aluminum salt.

In certain embodiments, the ASA may be added in the form of an emulsion. In certain embodiments, ASA is added as an emulsion in order to evenly distribute the ASA in the papermaking furnish. In certain embodiments, ASA is added directly or in another form.

It should be understood by those skilled in the art that ASA is insoluble in water. Since a surfactant is generally contained in the commercially available product of ASA, when it is dissolved in the water, an emulsion will generally form. However, such an emulsion is very unstable, and may cause hydrolysis of ASA, thereby influencing sizability and causing uneven distribution of the ASA in the papermaking furnish. To avoid this adverse effect, ASA may be emulsified using an emulsifier prior to addition to the papermaking process to provide a stable emulsion of ASA. To emulsify ASA more easily, a small amount of surfactant may be added to the ASA. In certain embodiments, excessive surfactant will cause a decrease in the sizing efficiency of the ASA. The selection of the emulsifier and the surfactant and the control of dosage can be reasonably determined by those skilled in the art according to their technical knowledge and conventional technical means.

The aluminum salt may be added to the papermaking process as a solid or liquid. In certain embodiments, a solid aluminum salt is dissolved in a liquid (e.g., water) to generate free aluminum ions. The addition of aluminum salt dissolved in other chemical solutions (e.g., organic solvent) is not excluded.

In certain embodiments, before the ASA is added, the pH of the papermaking furnish may be maintained or adjusted to a pH of about 4 to about 9. In certain embodiments, the pH is in a range of about 6.5 to about 8. It should be understood by those skilled in the art that the pH of the papermaking furnish may need to be adjusted according to actual conditions and by conventional technical means in the art.

In certain embodiments, the total amount of the ASA added to the papermaking process or a step in the papermaking process may be about 5 kilograms per ton of paper or less. It should be understood by those skilled in the art that the total addition amount of the ASA may be selected and adjusted by those skilled in the art based on performance requirement of the product, specific production process conditions, and the like. It should be understood by those skilled in the art that there may be different preferred ranges under different usage environments.

In certain embodiments, the total amount of the aluminum salt measured by $Al_2O_3$ added to a papermaking process or a step in the papermaking process may be at least about 10 kilograms per ton of paper. In certain embodiments, the total amount of the aluminum salt measured by $Al_2O_3$ added to a papermaking process or a step in the papermaking process is from about 0.3 to about 3 kilograms per ton of paper. It should be understood by those skilled in the art that the total amount of the aluminum salt added to a papermaking process or a step in the papermaking process may be selected and adjusted based on performance requirement of the product or specific production process conditions. In certain embodiments, the aluminum salt may be added in combination with one or more additional chemicals.

In certain embodiments, the aluminum salt may be added by directly spraying or by coating paper with an aluminum salt in one or more process steps during the papermaking process and/or in a subsequent paper processing step.

In certain embodiments, the aluminum salt used in the present application generates one or more free aluminum ions in aqueous solution. In certain embodiments, the aluminum salt is aluminum sulfate, aluminum chloride, polyaluminum chloride, or a combination thereof.

In certain embodiments, the ASA may be replaced with or used in combination with other internal sizing agents, wherein said other internal sizing agents can be rosin, AKD, and the like.

In certain embodiments, adding the ASA into the paper furnish and adding the aluminum salt in one or more process steps during the papermaking process results in an increase in usage efficiency of the internal sizing agent and the aluminum salt. While not wishing to be bound by any particular theory, it is believed that the hydrolysate of the sizing agent formed during the papermaking process is converted into an effective sizing component via the aluminum salt, thereby improving the sizing efficiency of the sizing agent. Accordingly, the sizing methods of the present applications can be particularly effective for paper having requirements of hot water penetration resistance time and high sizing degree.

Applicant has also found that adding the ASA into the paper furnish and adding the aluminum salt in one or more process steps during the papermaking process results in an improvement in sizing masking and sizing reversion of the paper over conventional methods. While not wishing to be bound by any particular theory, it is believed that aluminum salt ion reacts with the sizing agent and/or the hydrolysate of the sizing agent, reducing the free sizing agent and the hydrolysate of the sizing agent. Compared with internally adding the aluminum salt into the furnish, the aluminum salt retained on the paper sheet is greatly increased, while the possibility of losing aluminum salt in white water is reduced or eliminated.

In certain embodiments, paper produced using an aluminum salt has a high moisture content when compared to paper produced in the absence of an aluminum salt. In certain embodiments, paper produced by the present method has a moisture content of about 7% or more, which is greater than paper produced in the absence of an aluminum salt.

Compared to previously known methods, the sizing methods for making paper of the present application do not adversely influence the chemical environment of the wet part of the paper machine. Nor do the sizing methods for making paper of the present application adversely influence the production and making process of the paper machine.

The following examples further illustrate the invention but, of course, should not be construed as in any way limiting its scope.

Example 1

Effect of Aluminum Salt Treatment on the Sizing Degree

In this example, paper samples were treated with an aluminum salt by soaking the paper in various aluminum salt solutions. The paper was not treated with aluminum salt prior to paper web formation, but was instead surface treated.

Solutions having a pH of 3, 4, and 5 were prepared using $Al_2(SO_4)_3.14H_2O$ (aluminum alum). Prepared paper was individually soaked in each of the three solutions. For comparison, paper was also soaked in water having a pH of 7. The hot water penetration resistance time was determined for each sample. The hot water penetration resistance time reflects the sizing degree of paper. The results of the tests are shown in Table 1.

TABLE 1

| | pH | | | |
|---|---|---|---|---|
| | 3 | 4 | 5 | 7 |
| Time of the hot water penetration resistance (s) | 1800 | 1080 | 960 | 720 |

The results indicate that treatment of paper with the aluminum salt greatly increased the hot water penetration resistance time. Overall, the test demonstrates that the sizing degree of the paper can be greatly increased by treating the paper surface with an aluminum salt.

Example 2

Effect of Different Aluminum Salt Treatments on the Sizing Degree

Aluminum salt solutions having 10% percent by weight aluminum alum and aluminum chloride were prepared. Paper sheets prepared in the laboratory using different dosages of ASA were soaked in the aluminum solutions. The ASA was product N7543 from Nalco Company. The Cobb values of the paper were measured. The Cobb values were compared with the Cobb value of an untreated paper sheet to determine the degree of sizing. The results are shown in Table 2.

TABLE 2

| Dosage of ASA (kg/T) | Untreated Sheet Cobb value | Sheet Treated with 10% aluminum alum solution Cobb value | Sheet Treated with 10% aluminum chloride solution Cobb value |
|---|---|---|---|
| 0.9 | 229.25 | 26.3 | 30.9 |
| 1.2 | 195.6 | 29.5 | 24.6 |
| 1.5 | 121.6 | 23.4 | 28.3 |

The results show that the sizing degree of paper increased significantly after being treated with an aluminum chloride solution or aluminum alum solution.

Comparative Example 1

Comparative Example 1 is a process of adding the aluminum salt into a furnish, wherein the aluminum salt is added into the furnish pipe along with ASA. This Example was performed in a mill in China, where the prepared final paper faced serious problems of sizing masking and sizing reversion.

As for the paper produced from this paper mill, the time interval from paper winding to paper rewinding was merely about 2 hours. The time of the hot water penetration resistance of the paper decreased by 70% during such time interval. In order to maintain the sizing degree of the final paper at qualified value, this paper mill needed to increase the dosage of the sizing agent. For example, the dosage of ASA needed to be increased by about 20 to 30%. Once its paper was soaked with acetone solution, the time of the hot water penetration resistance was restored. Through spectral analysis on influencing substances, it was determined that the problems of sizing masking and sizing reversion were caused by the hydrolysate of the sizing agent.

ASA emulsion was added into a furnish pipe at a sieve export of a paper machine. The dosage of ASA was 3.6 to 4 kilograms per ton of paper. FIG. 1 shows the specific operation process. The pH value of the furnish was 6.5 to 7.5 before the ASA was added. The dosage of the aluminum salt was 8 to 10 kilograms.

Figure 3:
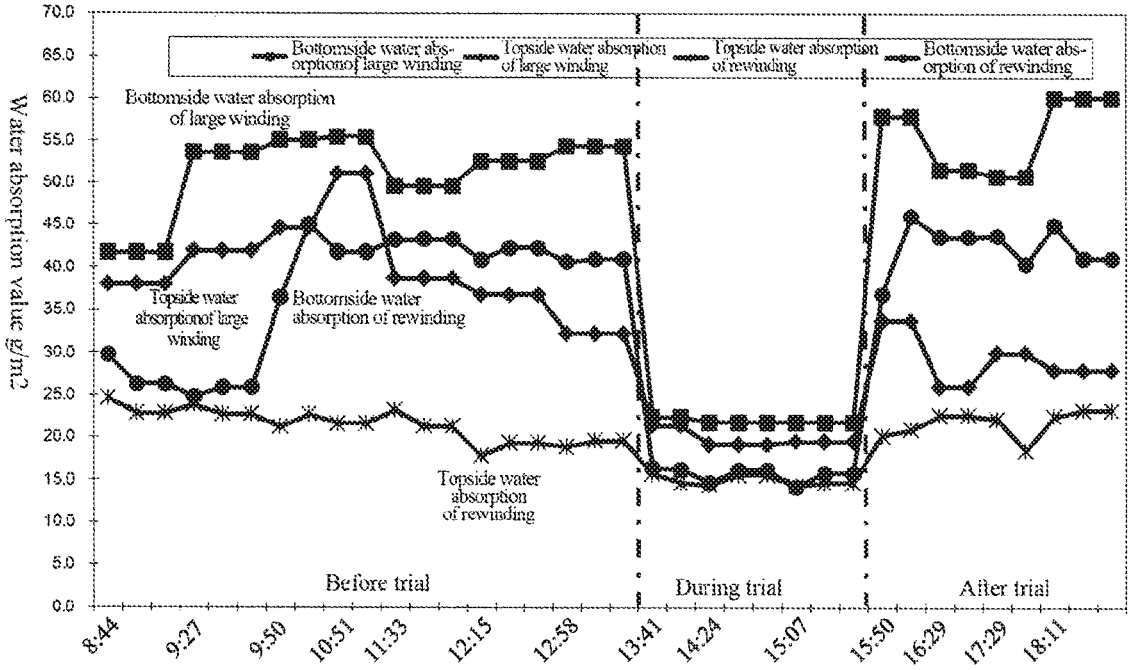
FIG. 3 shows variation of Cobb value of the paper before, during, and after a trial.
Figure 4:
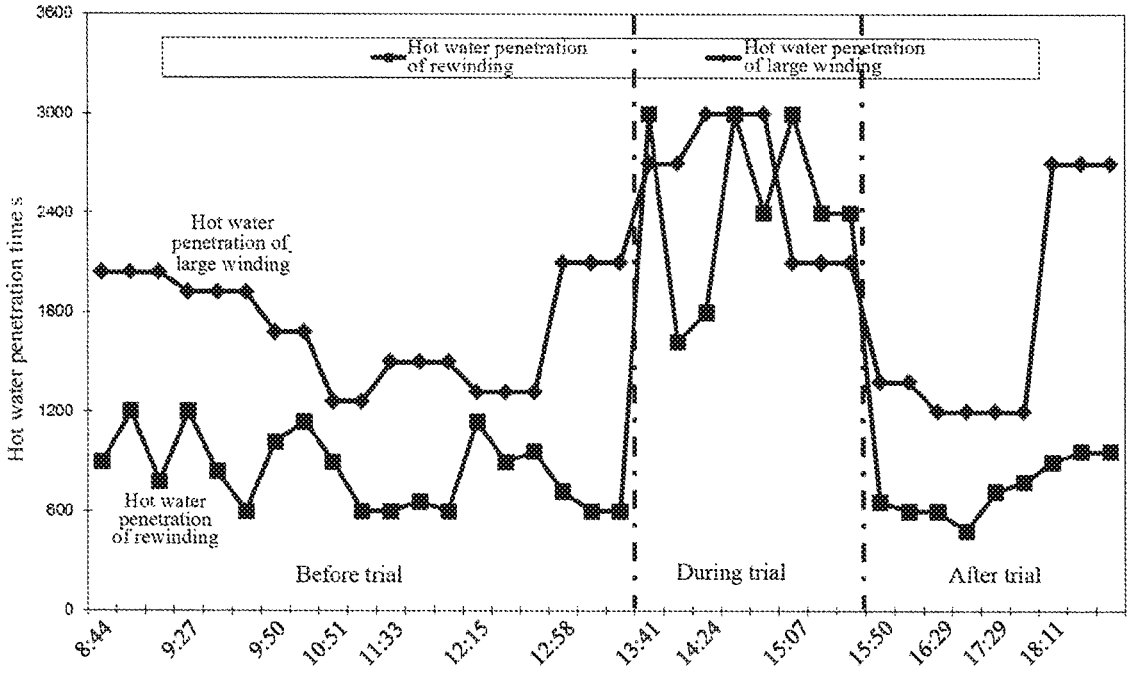
FIG. 4 shows variation of the hot water penetration resistance time of paper before, during, and after a trial.

The Cobb value and the time of the hot water penetration resistance of paper prepared according to Comparative Example 1 are shown in the "before trial" in FIG. 3 and FIG. 4.

Example 3

This Example was carried out using the same method and equipment as those of Comparative Example 1, except in the process step of the surface sizing section of this paper machine, an amount of aluminum alum ($Al_2(SO_4)_3.14H_2O$) (in the form of a solution) is added into the surface sizing agent. In this example, the surface sizing agent is a starch. The sizing degree of the final paper sampled after an interval of 2 hours was the same or greater.

Figure 2:
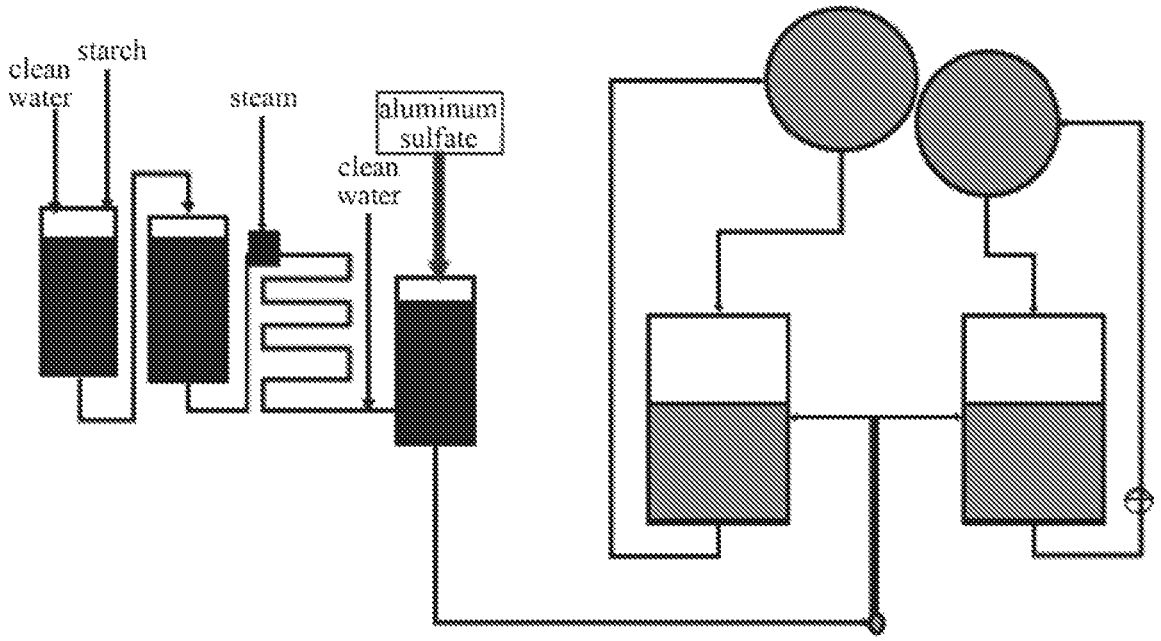
FIG. 2 is an operational flowchart of addition of aluminum sulfate in Example 2.

The specific technical solution and application of this production test was as follows:

1) ASA emulsion was added into the furnish pipe at the sieve export of the paper machine, wherein the dosage of ASA was 3 kilograms per ton of paper. FIG. 1 shows the specific operation process, wherein the pH value of the furnish before adding ASA is 6.5-7.5;

2) the aluminum sulfate solution was added into the starch surface sizing agent in the paper machine, the solid content of the aluminum sulfate solution was 30%, the surface sizing agent was adjusted to a pH of 3, and the dosage of aluminum alum was 4 kilograms per ton of paper. FIG. 2 shows the specific operation process, wherein the right half part of the figure is a surface sizing section, the two rectangular containers represent containers for storing sizing solution, and the two circles represent sizing rolls; and 3) the evenly mixed aluminum sulfate solution and the starch surface sizing agent were delivered to a surface sizing apparatus of the paper machine in accordance with normal production modes.

The measurement method of the time of hot water penetration resistance was the same as that in Example 1. Paper having a dimension of about 15 cm×15 cm was folded into a shape of container, and was floated in 95° C. hot water. The time which was required for penetrating the hot water through the paper to achieve a certain area percentage of the paper was determined as an index for judging the hot water penetration resistance property.

The Cobb value was measured according to "water absorptiveness of sized (non-bibulous) paper, paperboard, and corrugated fiberboard (Cobb test) (proposed revision of T441 om-09)" in TAPPI standard.

The results are shown in the "during trial" section of FIG. 3 and FIG. 4. It was observed that the Cobb value and the time of hot water penetration resistance greatly improved. Overall, the usage of an aluminum salt improved the sizing masking and sizing reversion problems. Furthermore, the usage efficiency of the sizing agent increased, reducing the dosage of the sizing agent by 20 to 30%.

Example 4

The Example was carried out using the same method as that of Example 3, except the aluminum salt was aluminum chloride or aluminum sulfate respectively, and the dosage of the aluminum salt was 10 kilograms per ton of paper. An aqueous solution of the aluminum salt was added by means of spraying at the forming section of the paper machine, and the dosage of ASA was 3.5 kilograms per ton of paper. The hot water penetration resistance of paper was measured. The test was compared with a blank paper sample where clean water was sprayed. The results are shown in Table 3.

TABLE 3

| Aluminum salt solution | Aqueous solution of 10% aluminum sulfate | Aqueous solution of 10% aluminum chloride | Clean water |
|---|---|---|---|
| Time of hot water penetration resistance (s) | 4800 | 6000 | 1200 |

The data illustrates that the hot water penetration resistance greatly improves in the presence of the aluminum salts.

Example 5

The Example was carried out using the same method as described in Example 4, except the aqueous solution of aluminum chloride or aluminum sulfate was respectively added by means of coating in the process step at the drying section. A blank paper sample coated with clean water was used as a control. The hot water penetration resistance of paper was measured. The results are shown in Table 4.

TABLE 4

| Aluminum salt solution | Aqueous solution of 10% aluminum sulfate | Aqueous solution of 10% aluminum chloride | Clean water |
|---|---|---|---|
| Time of hot water penetration resistance (s) | 1500 | 900 | 420 |

The data illustrates that the hot water penetration resistance greatly improves in the presence of the aluminum salts.

Example 6

The Example was carried out using the same method as that of Example 3, except the aqueous solution of aluminum sulfate or aluminum chloride was further added by means of coating in the process step at the press section. A blank sample paper coated with clean water was used as a control. The hot water penetration resistance of paper was measured. The results are shown in Table 5 below.

TABLE 5

| Aluminum salt solution | Aqueous solution of 10% aluminum sulfate | Aqueous solution of 10% aluminum chloride | Clean water |
|---|---|---|---|
| Time of hot water penetration resistance (s) | 1800 | 2400 | 600 |

The data illustrated the hot water penetration resistance greatly improves in the presence of the aluminum salts.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Embodiments of this invention are described herein, including the best mode known to the inventors for carrying out the invention. Variations of these embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A sizing method for making paper, the method comprising:

adding alkenyl succinic anhydride to a papermaking furnish in a papermaking process, and adding an aluminum salt to one or more process steps during the papermaking process via surface treatment, wherein the surface treatment comprises spraying the aluminum salt onto a surface of a paper sheet in the one or more process steps during the papermaking process, wherein alkenyl succinic anhydride Is not added in the one or more process steps via a surface treatment, wherein the one or more process steps during the papermaking process are selected from a process step at a forming section of the paper machine, a process step at a multilayer paperboard combining section, a process step at a press section, a process step at a drying section, a process step at a surface sizing section, and a combination thereof, wherein the aluminum salt is added to the papermaking process in an amount greater than 0.3 kilograms per ton of paper, and the alkenyl succinic anhydride is added in an amount of at least 0.9 kilograms per ton of paper.

2. The sizing method of claim 1, wherein the one or more process steps during the papermaking process is a process step at a surface sizing section.

3. The sizing method of claim 1, wherein the alkenyl succinic anhydride has the following structure

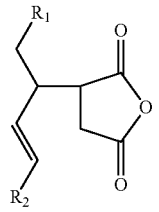

wherein, $R_1$ and $R_2$ are alkyl.

4. The sizing method of claim 3, wherein each of $R_1$ and $R_2$ is $C_{12}$-$C_{22}$ alkyl.

5. The sizing method of claim 1, wherein the alkenyl succinic anhydride is added to the papermaking furnish as an emulsion.

6. The sizing method of claim 1, wherein the papermaking furnish has a pH of from 4 to 9 before the addition of alkenyl succinic anhydride.

7. The sizing method of claim 1, wherein the aluminum salt is alum, aluminum chloride, polyaluminum chloride, or a combination thereof.

8. The sizing method of claim 1, wherein the aluminum salt is added to the papermaking process in an amount of from 0.3 kilograms to 3 kilograms per ton of paper.

9. The sizing method of claim 1, wherein the aluminum salt is added to the papermaking process in combination with an alkyl ketene dimer ("AKD").

10. The sizing method of claim 9, wherein the aluminum salt is alum, aluminum sulfate, aluminum chloride, polyaluminum chloride or a combination thereof.

11. The sizing method of claim 1, wherein the aluminum salt is added to the papermaking process in combination with a starch.

12. The sizing method of claim 11, wherein the aluminum salt is alum, aluminum sulfate, aluminum chloride, polyaluminum chloride or a combination thereof.

13. A sizing method for making paper, the method comprising:

adding alkenyl succinic anhydride to a papermaking furnish in a papermaking process, and adding an aluminum salt to one or more process steps during the papermaking process via surface treatment, wherein the surface treatment comprises spraying the aluminum salt onto a surface of a paper sheet in the one or more process steps during the papermaking process, wherein alkenyl succinic anhydride Is not added in the one or more process steps via a surface treatment, wherein the one or more process steps during the papermaking process are selected from a process step at a forming section of the paper machine, a process step at a multilayer paperboard combining section, a process step at a press section, a process step at a drying section, a process step at a surface sizing section, and a combination thereof, wherein the aluminum salt is added to the papermaking process in an amount of at least 10 kilograms per ton of paper, and the alkenyl succinic anhydride is added in an amount of up to and including 5 kilograms per ton of paper.

* * * * *